United States Patent [19]

Akesson

[11] Patent Number: 4,600,159

[45] Date of Patent: Jul. 15, 1986

[54] PROCESS AND MACHINE FOR DISINTEGRATING MATERIALS

[75] Inventor: Yngve R. Akesson, Helsingborg, Sweden

[73] Assignee: Nestec S.A., Vevey, Switzerland

[21] Appl. No.: 759,514

[22] Filed: Jul. 26, 1985

Related U.S. Application Data

[63] Continuation of Ser. No. 486,866, Apr. 20, 1983, abandoned.

[30] Foreign Application Priority Data

Apr. 21, 1982 [EP] European Pat. Off. ..... 82103369

[51] Int. Cl.[4] ..... B02C 18/26

[52] U.S. Cl. ..... 241/280; 241/282.1; 241/283

[58] Field of Search ..... 241/283, 205, 202, 260.1, 241/277, 280, 282, 199.2, 199.3, 199.4, 199.7, 199.8, 199.11, 199.12, 292.1, 293, 282.1, 282.2

[56] References Cited

U.S. PATENT DOCUMENTS

| | | | |
|---|---|---|---|
| 747,905 | 12/1903 | Curtiss | 241/277 |
| 2,515,923 | 7/1950 | Hansen | 241/280 X |
| 3,472,298 | 10/1969 | Vinogradov et al. | 241/277 |
| 4,117,980 | 10/1978 | Hartmann | 241/205 X |
| 4,165,045 | 8/1979 | Hager et al. | 241/282 |
| 4,258,886 | 3/1981 | Londahl et al. | 241/280 X |
| 4,509,700 | 4/1985 | Svengren | 241/280 |

*Primary Examiner*—Mark Rosenbaum
*Assistant Examiner*—Joseph M. Gorski
*Attorney, Agent, or Firm*—Vogt and O'Donnell

[57] ABSTRACT

A process and machine for disintegrating materials wherein the material is delivered to a disintegrating element which receives a reciprocating movement whose path is substantially parallel to the surface to be comminuted wherein the disintegrating element comprises at least one rotary cutter whose axis of rotation is substantially parallel to the surface to be comminuted with a blade having a cutting edge substantially parallel to and directed transversely to the axis of rotation whereby comminution takes place on simultaneous reciprocation of the disintegrating element and rotation of the cutter.

11 Claims, 4 Drawing Figures

Figure 1:
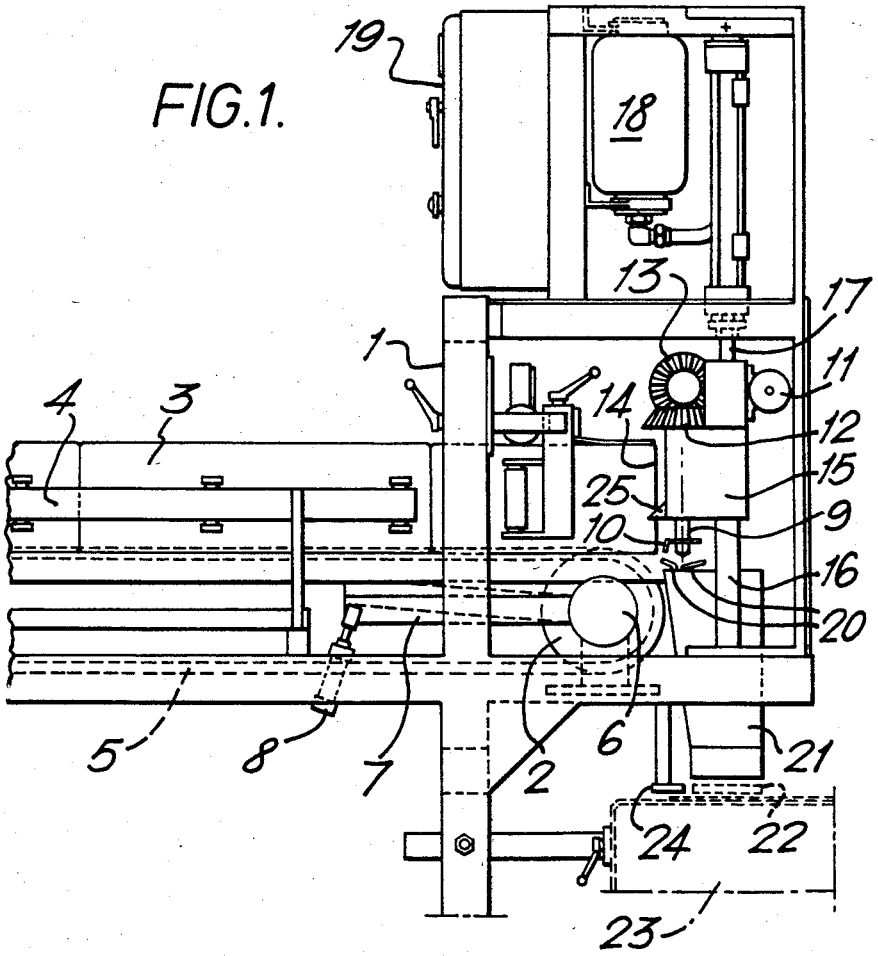

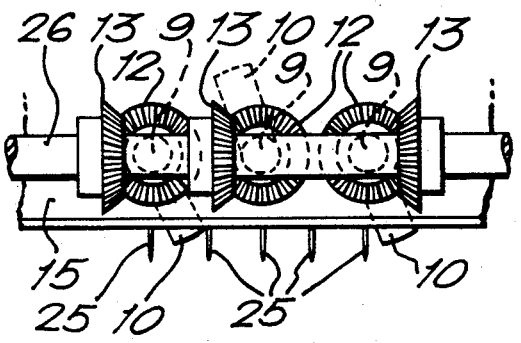
FIG.2.
FIG.3.
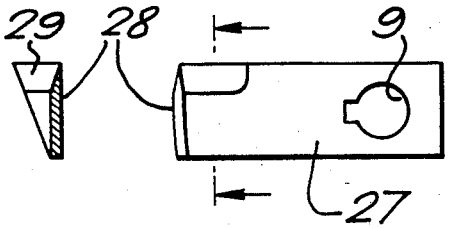
FIG.4.
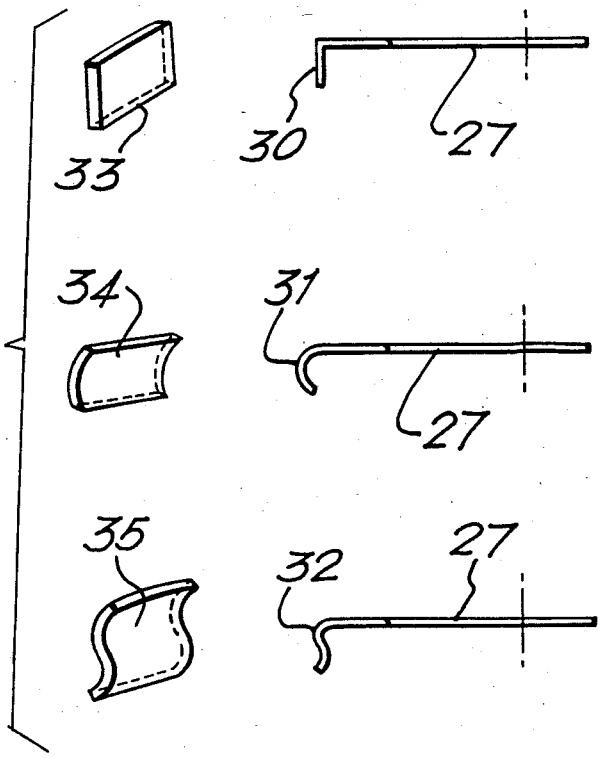

PROCESS AND MACHINE FOR DISINTEGRATING MATERIALS

This is a continuation of co-pending application Ser. No. 486,866, filed on Apr. 20, 1983, abandoned.

This invention relates to a process of and a machine for disintegrating materials, more particularly food products. The machine according to the invention is primarily intended for the disintegration of food products in the form of fairly large pieces or blocks, such as sausages and compressed meats, but especially cheese.

There are various known machines for disintegrating food products, such as for example graters, slicing machines, mills, etc. These known machines have satisfied the requirements made of them fairly well where it has been a question of producing relatively large pieces, such as slices, or where the products to be disintegrated have been relatively dry and firm, such as raw vegetables, hard and dry cheeses, etc. It has also been possible not only to disintegrate but also to portion the material.

However, disintegration and portioning have involved problems where the products in question have been fairly soft and sticky, such as various delicatessen and cheeses having a high or moderately high fat content. It has been particularly difficult to disintegrate cheese because, due to the fatty and sticky consistency of cheese, the particles obtained have tended to adhere to the cutting implement or even to one another to form fairly large lumps. Hitherto, there has been no machine capable of simultaneously disintegrating and, if necessary, portioning materials as difficult as these in a variable manner. This has given rise to considerable difficulties in the automatic machinery used for the production of prepared dishes, for example when grated cheese has to be sprinkled over a pizza or when a gratin has to be subsequently frozen and delivered in this state to the consumer for final preparation. If, in this case, the cheese is not uniformly distributed over the dish, it will melt unevenly during the final heating so that the finished dish will have a less appetizing appearance.

The present invention enables the disadvantages referred to above to be obviated and provides for the uniform disintegration of food products which, previously, were difficult to use from this point of view. The method and the machine according to the invention are particularly intended for the disintegration of cheese, although other food products in piece form, such as minced meat and pressed ham, may advantageously be disintegrated in accordance with the invention.

In general, conventional machines for disintegrating various food products in piece form have been completely different models according to the type of food product to be treated. It would be extremely desirable both from the practical and from the economic point of view for different types of food products to be able to be treated essentially in the same apparatus in which only a few elements would need to be replaced for adaptation to the different mechanical and rheological properties of different food products. The present invention enables this object to be achieved and the same apparatus may be used for different food products, such as cheese, meat and delicatessen, for example pressed ham and minced meat, sausage either in the form of fairly large individual sausages or in the form of several small sausages together, and other materials, only the elements used for the actual disintegration process having to be specially adapted to the type of food product to be treated.

In our European Pat. No. 0005495, we describe and claim a method for disintegrating materials wherein the material is delivered to a driven disintegrating element which receives a reciprocating movement substantially parallel to one surface of the material and, in doing so, comminutes the material on that surface, characterised in that the driven disintegrating element is in the form of a rotary screw of which the screwthread is provided with a cutting edge directed frontwards in the axial direction in which the thread appears to move during rotation of the screw.

The material is preferably fed intermittently to the disintegrating element.

However this cutting system has limited flexibility with regard to the shape and dimensions of the shreds that may be obtained. We have now developed a new cutting system by means of which shreds of a wider variety of shapes and dimensions can be obtained in a controlled manner.

According to the present invention, there is provided a machine for disintegrating materials which comprises a disintegrating element designed to receive a reciprocating movement, means for delivering the material so that the surface to be comminuted is disposed substantially parallel to the path of the reciprocating movement characterised in that the disintegrating element comprises at least one rotary cutter whose axis of rotation is substantially parallel to the surface to be comminuted, with a blade having a cutting edge which is substantially parallel to and directed transversely to the axis of rotation and which is adapted to engage the surface to be comminuted.

The invention also provides a process of disintegrating materials wherein the material is delivered to a disintegrating element which receives a reciprocating movement whose path is substantially parallel to the surface to be comminuted characterised in that the disintegrating element comprises at least one rotary cutter whose axis of rotation is substantially parallel to the surface to be comminuted with a blade having a cutting edge substantially parallel to and directed transversely to the axis of rotation whereby comminution takes place on simultaneous reciprocation of the disintegrating element and rotation of the cutter.

Preferably the axis of rotation of the rotary cutter is parallel to the path of the reciprocating movement of the disintegrating element.

The rotary cutter may, if desired, rotate in both directions in which case the blade may have two cutting edges so that the leading edge of the rotating blade can comminute the material in each direction of rotation.

The rotary cutter is advantageously fitted to a rotary axis comprised in the disintegrating element and is conveniently in the form of a knife comprising a shaft with a blade having a cutting edge. When there are two or more rotary cutters, they may all be fitted to the same axis, but preferably there is more than one rotary axis to each of which is fitted one or more rotary cutters. For example, there may be up to 5 rotary cutters, preferably with one rotary cutter fitted to a separate rotary axis. The length of the shreds of material may be controlled by varying the number of rotary cutters, shorter pieces being obtained with more cutters.

The disintegrating element is conveniently fixed to a support which reciprocates with it but does not rotate. If desired one or more fixed cutters may be fitted to the support with blades having cutting edges orientated in at least one of the directions of the reciprocating movement. These fixed cutters provide another way of controlling the length of the shreds by shortening them and are particularly useful for cutting ham into rectangular pieces. The number of fixed cutters present is preferably from 3 to 6.

Furthermore, by varying the shape and size of the cutting edges of the rotary cutters, the shape of the shreds of the material can be varied.

Preferably the rotary cutters are removable from the rotary axis so that shreds of material of different shapes and dimensions may be obtained by fitting different numbers of rotary cutters with blades having cutting edges of the appropriate shape.

The cutting edges of the blades may have a taper angle, for instance up to 10°, and preferably from 2° to 7°. The length of the rotary axis may be adapted to optionally standardised dimensions of the piece-form food products being treated.

The height of each individual shred can be controlled by adjusting the speed of the reciprocating movement of the disintegrating element. Conveniently, speeds of from 5 to 20 cm per second are suitable but, if desired, speeds outside this range may be used depending on the requirements.

The thickness of the shreds can be controlled by adjusting the delivery rate of the material to be disintegrated; a higher delivery rate produces thicker shreds. Preferably, the material is intermittently delivered when the disintegrating element is at one end of its reciprocating movement and a delivery rate of from 2.5 to 7.5 mm per step has been found to be suitable, the exact rate employed depending on the requirements.

A certain minimum speed of rotation of the rotary cutters is desirable for sticky materials such as cheese, as a centrifugal force is necessary to throw the cut pieces away from the material and the cutting edges of the blades. A rotational speed of from 1500 to 2000 revolutions per minute has been found to be suitable.

It is possible to act on the degree of disintegration in the case of certain materials, for example cheese, by passing the block of material to a cutter which divides it along its longitudinal axis before it reaches the disintegrating element. In the case of cheese, it may be forced for example beyond one or more cutting wires or grids. This is yet another way to obtain shorter cuttings.

Thus, an extremely versatile cutting system is provided by the present invention whereby almost any requirement of shape, dimension and appearance may be obtained, as desired.

The direct portioning of material which is obtained with one or more rotary cutters of the disintegrating element of the invention enables any other handling of the disintegrated material to be avoided, which saves work and reduces losses of material. Since portioning may be regulated with high precision to the required length, overportioning with its inherent losses is also avoided. The disintegrated material may be satisfactorily and uniformly distributed by virtue of the fact that it may drop into a funnel and then onto a prepared dish, for example a pizza or a gratin, which passes below the machine on a conveyor. In order to obtain the best results, it is advisable to adapt the size and shape of the funnel to the prepared dish intended to receive the disintegrated material.

In the method according to the invention, a rotating knife as the cutting element has proved to be particularly suitable for the disintegration of cheese and also pressed meats, such as ham or various types of brawn, in the form of blocks of suitable size. The food products may be frozen, refrigerated or kept at ambient temperature and, in some cases, the temperature acts on the treatment properties during disintegration. Thus, in the disintegration of high-fat cheese, it has proved to be advisable to cool the cheese because, in this way, it assumes a less sticky consistency. By contrast, cheese having a fat content of 45% and higher, based on dry matter, may readily be disintegrated at ambient temperature. This is a major advantage of the method and the machine according to the invention over known machines of the grater or similar type where the sticky consistency of cheese gives rise to difficulties.

The purely technical design of the machine according to the invention is conventional and may readily be determined by the expert. For example, it is important that the machine may be easily cleaned in a manner compatible with food products.

The invention is further illustrated by way of example with reference to the following drawings in which:

FIG. 1 diagrammatically illustrates a machine according to the invention in its entirety.

FIG. 2 is a detailed view of a disintegrating element together with a drive system for imparting rotation thereto.

FIG. 3 designates a detailed plan view of a knife and a blade.

FIG. 4 designates side views of some possible shapes of the cutting edges of the knife blades with the corresponding appearance of the shreds obtained.

As shown in FIG. 1, the machine consists essentially of a frame 1 supporting a conveyor 2 for a food product 3 in block form, for example a cheese. Guides 4 are also provided to ensure correct feeding. The conveyor is preferably in the form of a chain conveyor with a toothed conveying chain 5 and is driven by a ratchet mechanism 6 of which the control arm 7 is activated by a pneumatic jack 8.

A disintegrating element comprises a rotary axis 9 fitted to which is a knife 10 driven by a motor 11 through the gear wheel 12 via the intermediate wheel 13. The disintegrating element is brought opposite the front surface 14 of the block-form food product 3 and is fixed to a support 15, and the whole assembly may be moved upwards or downwards along guide bars 16 by means of the piston rod 17. The movement is imparted by means of the diagrammatically illustrated apparatus 18 which is controlled by the control unit 19. The particles 20 of the food product which are formed during disintegration fall through the funnel 21 onto a prepared dish 22, for example a pizza, which is delivered by a conveyor, for example a belt conveyor, indicated at 23. A detector 24, which acts on the control unit 19, ensures that no disintegration takes place if there is nothing on the conveyor belt to receive the disintegrated product. By fitting one or more fixed knives 25 to the support 15, the length of the particles 20 can be shortened, if required, for example when disintegrating ham.

The control unit 19 enables both the advance of the conveyor 2 and the transport and drive of the disintegrating element to be controlled in such a way that a suitable length of the block-form food product 3 is advanced when the disintegrating element is in its upper position, respectively in its lowered position, after which the disintegrating element is lowered, respectively lifted up and driven for disintegration to take place. The ratchet mechanism 6 prevents the block-form food product from rebounding while the disintegrating element is in operation. It is not always necessary for the disintegrating element to be driven only when it is in its lowered, respectively in its ascended position, although this does represent a preferred embodiment.

The drive system used for driving the conveyor 2 and the rotary axis 9 and also for raising and lowering the disintegrating element may be electrical or hydraulic, although it is preferred to use a pneumatic drive system. The reason for this is that any apparatus of the type used for treating food products is often situated in a damp atmosphere and has to be able to be thoroughly cleaned and disinfected, for example by washing under high pressure. In the case of an electrical apparatus, this can give rise to difficulties in the form of short-circuiting and sparking which may also endanger personnel. Control units for controlling pneumatic apparatus in the manner described here are already known to the expert and may be assembled from commercially available components. A hydraulic apparatus may be used on condition that the hydraulic fluid employed is compatible with food products, for example an edible oil.

FIG. 2 illustrates a disintegrating element comprising three rotary axes 9 to which are fitted rotary knives 10. The rotary axes are driven by a motor (not shown) through the gear wheels 12 via the intermediate wheels 13 having a common axis 26. The disintegrating element is fixed to a support 15 to which are fitted five knives 25 which reciprocate with the disintegrating element.

FIG. 3 illustrates a knife, fitted to a rotary axis 9, consisting of a shaft 27 with a blade 28 having a cutting edge 29 with a taper angle of 5°.

FIG. 4 illustrates three knife shafts 27 with cutting edges 30, 31 and 32 which produce shreds of material 33, 34 and 35, respectively.

I claim:

1. A machine for disintegrating a soft food material, said machine comprising:

(a) a disintegrating element incorporating at least one rotary cutter, said at least one rotary cutter having an axis of rotation, an elongated arm extending transversely with respect to said axis of rotation, and a fin-like blade having two oppositely-facing major surfaces, said blade projecting from said arm and being remote from said axis of rotation, said major surfaces of said blade being generally parallel to said axis of rotation, one of said major surfaces facing said axis of rotation, said blade having a first cutting edge that extends generally parallel to said axis of rotation;

(b) means for reciprocating said disintegrating element so that the cutter moves along a path in a predetermined plane of reciprocation;

(c) means for rotating said cutter about said axis of rotation so that said blade orbits about said axis of rotation, said axis of rotation being disposed parallel to said plane of reciprocation; and (d) means for positioning a mass of said soft food material so that a surface of said mass is disposed substantially parallel to both said plane of reciprocation and said axis of rotation, and so that said blade intermittently engages said surface of said mass and shaves shreds of material from said mass as the blade orbits about said axis of rotation and sweeps across said surface while the disintegrating reciprocates.

2. A machine according to claim 1, wherein said disintegrating element includes a shaft to which said cutter is attached, said shaft having an axis of rotation that is coincident with the axis of rotation of said cutter.

3. A machine according to claim 2, further comprising a plurality of shafts, with a cutter being attached to each of said shafts.

4. A machine according to claim 2, wherein the cutter is removable from said shaft.

5. A machine according to claim 1, wherein the means for rotating the cutter is operative to rotate the cutter in two directions about said axis of rotation, and wherein said blade has a second cutting edge that is directed oppositely from said first cutting edge, such that one of said first and second cutting edges engages said surface of the mass in each direction of rotation of the cutter.

6. A machine according to claim 1, wherein the means for positioning comprises a conveyor having an inlet end, a discharge end adjacent the disintegrating element, and means for cutting the mass that is positioned between said inlet and discharge ends, said cutting means being operative to cut said mass in a direction that is perpendicular to said surface of the mass.

7. A machine according to claim 1, further comprising means for positioning a food product beneath said disintegrating element such that disintegrated material is deposited on said food product.

8. A machine according to claim 1, wherein the cutting edge has a taper angle that is between 2° and 7° inclusive.

9. A machine according to claim 1, further comprising: (i) a support to which the disintegrating element is mounted, said support being reciprocated along said path by said means for reciprocating said disintegrating element; and (ii) at least one fixed cutter incorporating at least one blade that is fixedly mounted to said support and has a cutting edge that is oriented in and faces a direction parallel to said path, wherein said means for positioning a mass of said soft food is operative to engage said surface of the mass with said at least one blade, whereby said surface is scored by said at least one blade upon reciprocation of said support.

10. A machine according to claim 9, wherein three to six fixed cutters are present.

11. A machine according to claim 1, wherein the material to be disintegrated is intermittently delivered to the disintegrating element.

* * * * *

UNITED STATES PATENT AND TRADEMARK OFFICE
CERTIFICATE OF CORRECTION

PATENT NO. : 4,600,159
DATED : JULY 15, 1986
INVENTOR(S) : Yngve R. Akesson

It is certified that error appears in the above—identified patent and that said Letters Patent is hereby corrected as shown below:

On the title page, under the heading References Cited, "Londahl et al." should read -- Lundahl et al. --.

Column 6, Line 10, (Claim 1), after "disintegrating" insert the word -- element --.

Signed and Sealed this
Seventh Day of October, 1986

[SEAL]

*Attest:*

*Attesting Officer*

DONALD J. QUIGG
*Commissioner of Patents and Trademarks*